United States Patent [19]

Townsend et al.

[11] Patent Number: 5,003,162

[45] Date of Patent: Mar. 26, 1991

[54] HEATER WITH ALERT INDICATOR

[75] Inventors: Donald L. Townsend, Chandler; Robert A. White, Tempe, both of Ariz.

[73] Assignee: Arvin Industries, Inc., Columbus, Ind.

[21] Appl. No.: 504,043

[22] Filed: Apr. 3, 1990

Related U.S. Application Data

[63] Continuation of Ser. No. 312,363, Feb. 14, 1989, abandoned, which is a continuation of Ser. No. 156,881, Feb. 18, 1988, abandoned, which is a continuation-in-part of Ser. No. 311, Jan. 5, 1987, Pat. No. 4,755,653.

[51] Int. Cl.[5] ..... H05B 1/02

[52] U.S. Cl. ..... 219/506; 219/494; 200/61.25; 340/815.01; 340/500

[58] Field of Search ..... 219/452, 252, 501, 506, 219/497, 494, 363, 364, 439, 386, 358; 340/582, 500, 384 R, 815.01, 521, 584; 200/61.25

[56] References Cited

U.S. PATENT DOCUMENTS

| | | | |
|---|---|---|---|
| 974,638 | 11/1910 | Braly | 219/377 |
| 3,066,202 | 11/1962 | Kaleba et al. | 200/61.5 |
| 3,201,548 | 8/1965 | Mertler | 200/138 |
| 3,271,546 | 9/1966 | Chesnut | 200/138 |
| 3,487,394 | 12/1969 | Lee | 340/252 |
| 3,610,882 | 10/1971 | Omohundro | 219/377 |
| 3,637,981 | 1/1972 | Swimmer | 219/347 |
| 3,731,247 | 5/1973 | Levinn | 337/140 |
| 3,878,539 | 4/1975 | Gooding | 340/276 |
| 3,936,786 | 2/1976 | Peterson et al. | 337/801 |
| 4,127,854 | 11/1978 | Gardner et al. | 340/640 |
| 4,135,079 | 1/1979 | McGraw | 219/506 |
| 4,158,126 | 6/1979 | Seitz | 219/386 |
| 4,518,847 | 5/1985 | Horst, Sr. et al. | 218/365 |
| 4,580,038 | 4/1986 | O'Loughlin | 219/506 |
| 4,634,842 | 1/1987 | Payne | 219/486 |
| 4,755,653 | 7/1988 | Townsend et al. | 219/358 |

FOREIGN PATENT DOCUMENTS

| | | |
|---|---|---|
| 1059127 | 6/1957 | Fed. Rep. of Germany . |
| 2658731 | 12/1970 | Fed. Rep. of Germany . |
| 3506784 | 8/1985 | Fed. Rep. of Germany . |
| 2301989 | 2/1975 | France . |
| 52-56454 | 4/1977 | Japan . |
| 55-157002 | 12/1980 | Japan . |
| 1210319 | 10/1970 | United Kingdom . |

OTHER PUBLICATIONS

HFD-The Weekly Home Furnishings Newspaper-Nov. 2, 1987.

HFD-The Weekly Home Furnishings Newspaper--Mar. 14, 1988.

*Primary Examiner*—M. H. Paschall

*Attorney, Agent, or Firm*—Barnes & Thornburg

[57] ABSTRACT

A heater assembly includes heating element for generating heat to warm a space to be heated. A heat sensor is provided sensing the temperature within the radiant heater assembly for automatically disabling the heater elements upon exposure of the sensor to temperature in excess of a predetermined threshold temperature. A tip-over switch is provided for disabling the heater elements in resonse to predetermined tilting movement of the radiant heater assembly relative to a normal upright position. Alert indicators are provided for indicating disablement of the heater elements upon actuation of either the heat sensor or tip-over switch.

20 Claims, 2 Drawing Sheets

HEATER WITH ALERT INDICATOR

This is a continuation-in-part of our earlier copending application Ser. No. 07/000,311 filed Jan. 5, 1987 issued as U.S. Pat. No. 4,755,653 on July 5, 1988 which is a continuation of application Ser. No. 07/156,881 filed February 18, 1988, now abandoned, which is a continuation of application Ser. No. 07/312,363 filed February 14, 1989, now abandoned.

BACKGROUND AND SUMMARY OF THE INVENTION

The present invention relates to heaters. More particularly, the present invention relates to a heater assembly that includes at least one alert indicator for signaling the operator that the heater has been disabled because of a tip-over condition.

In conventional electric heaters, it is known to provide an overheat sensor for disabling the heater in the event of an overheat condition. It is also known in such heaters to provide a tip-over switch that disables the heater in the event of a tip-over condition. In this type of known heater, a conventional thermostat is normally included which permits the operator to select the ambient temperature at which the heater will turn on and off. Thus, the operator is generally able to select the ambient temperature within the space to be heated.

One object of the present invention is to provide an alert system in an electric heater that will signal the operator that an abnormal condition exists with the heater. Advantageously, this alert system will signal the operator that the heater has been disabled because of a tip-over condition, thereby improving the ability of the operator to monitor the operation of the heater. This alert system can also be used to signal the operator that the heater has been disabled because of an overheat condition.

According to the present invention, a heater assembly is provided that includes heater means for generating heat to warm a space to be heated. The heater assembly also includes sensor means for sensing temperature within the heater assembly. Alert means is provided for indicating disablement of the heater means. Tip-over means is provided for activating the alert means in response to predetermined tilting movement of the heater assembly relative to a normal upright position.

Overheat means can also be provided for automatically disabling the heater means upon exposure of the sensor means to a temperature in excess of a predetermined threshold temperature. The overheat means can also trigger the alert means to signal disablement of the heater means.

One feature of the foregoing structure is that alert means is provided for indicating disablement of the heater means upon actuation of the overheat means. One advantage of this feature is that the operator is alerted when an abnormal condition exists within the heater.

Another feature of the foregoing structure is that tip-over means is provided for activating the alert means independent of actuation of the overheat means in response to predetermined tilting movement of the radiant heater assembly relative to a normal upright position. One advantage of this feature is that the single alert means can be activatable independently by the tip-over means and the overheat means to alert the operator of an abnormal condition.

In preferred embodiments of the present invention, the alert means includes a light and a buzzer that are both activated upon actuation of the overheat means or, or upon actuation of the tip-over means. Provision of such an alert system advantageously enables an operator to monitor the operation of the heater during use and determine, by sight or sound, whether the heater has been disabled by normal operation of the thermostat or by operation of either the overheat or tip-over means.

Another feature of the foregoing structure is that two types of indicators are provided for alerting the operator of an abnormal condition. One advantage of this feature is that the operator is provided both with an aural signal and a visual signal of an abnormal heater operation condition.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying drawings which diagrammatically illustrate two preferred embodiments for an electrical circuit for use in a heater in accordance with the invention.

DETAILED DESCRIPTION OF THE DRAWINGS

Figure 1:
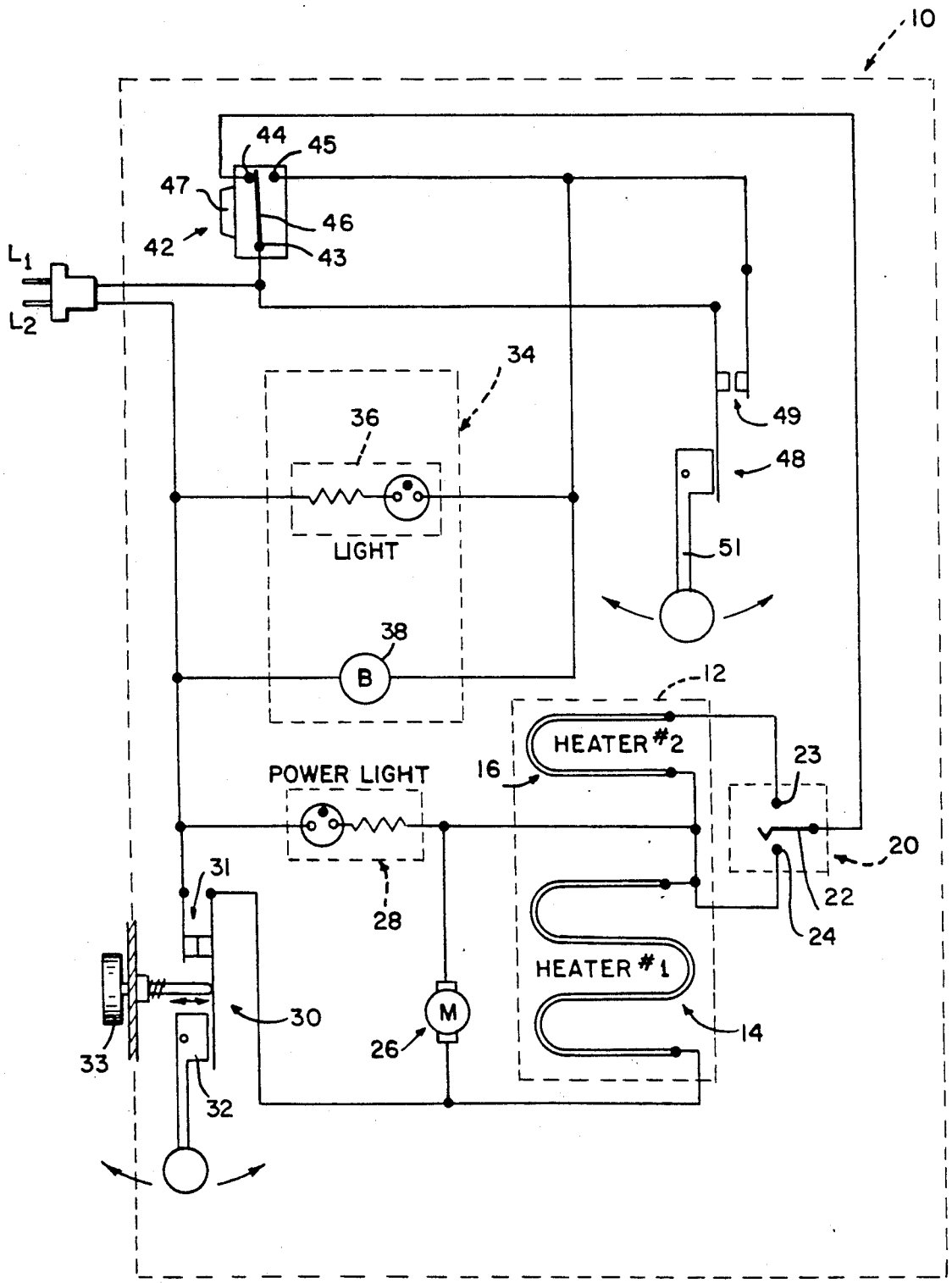
FIG. 1 shows a circuit for a heater using the present invention having two tip-sensitive switches.
Figure 3:
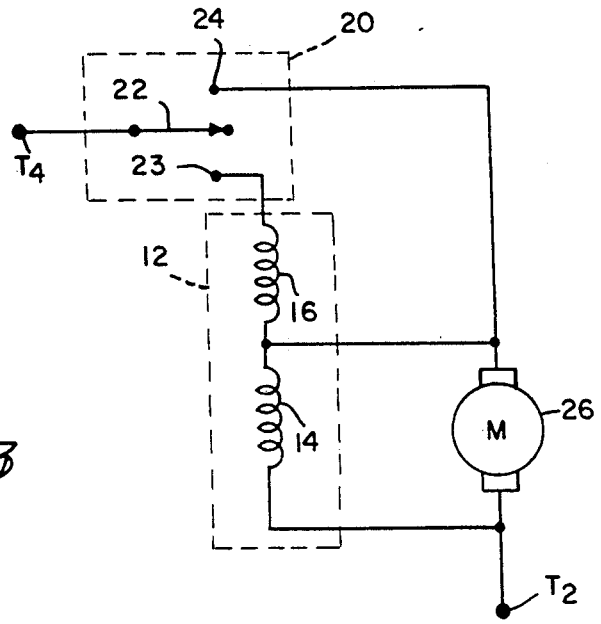
FIG. 3 shows a heater circuit for use with the circuit of FIG. 2.

A heater assembly 10 is shown in FIGS. 1 and 3 to include a conventional heater section 12. The heater section 12 includes a first heater element 14 and a second heater element 16. The first heater element 14 and second heater element 16 are controlled by a heat selector switch 20. The heat selector switch 20 is a conventional three position selector switch that includes a switch arm 22. The switch arm 22 is connected to a first pole L1 of the incoming power supply. The switch arm 22 is movable to any of three positions to control the function of the heater section 12. When the switch arm 22 is in the center-off position (as illustrated in the drawing), no power is being delivered to the heater section 12. When the switch arm 22 is moved to be in contact with the terminal 23, power is supplied to both the second heater element 16 and the first heater element 14 to produce a lower amount of heat from the heater section 12. When the switch arm 22 is moved to contact the terminal 24, only the first heater element 14 receives power, which results in a higher heat output from the heater section 12.

The heater assembly 10 also includes a fan motor 26. One terminal of motor 26 is connected to terminal 24 to lie in parallel with first heater element 14 and also to the terminal 23 to lie in series with second heater element 16. The motor 26 receives power whenever the heat selector switch 20 is in either of the two "on" positions. The motor 26 drives a fan (not shown) that conventionally circulates air around and through the reflector portion (not shown) of the heater assembly 10 to increase the heating capability and effectiveness of the heater assembly 10. The other terminal of the motor 26 is coupled through a conventional thermostat 30 to a second pole L2 of the incoming power supply.

Figure 2:
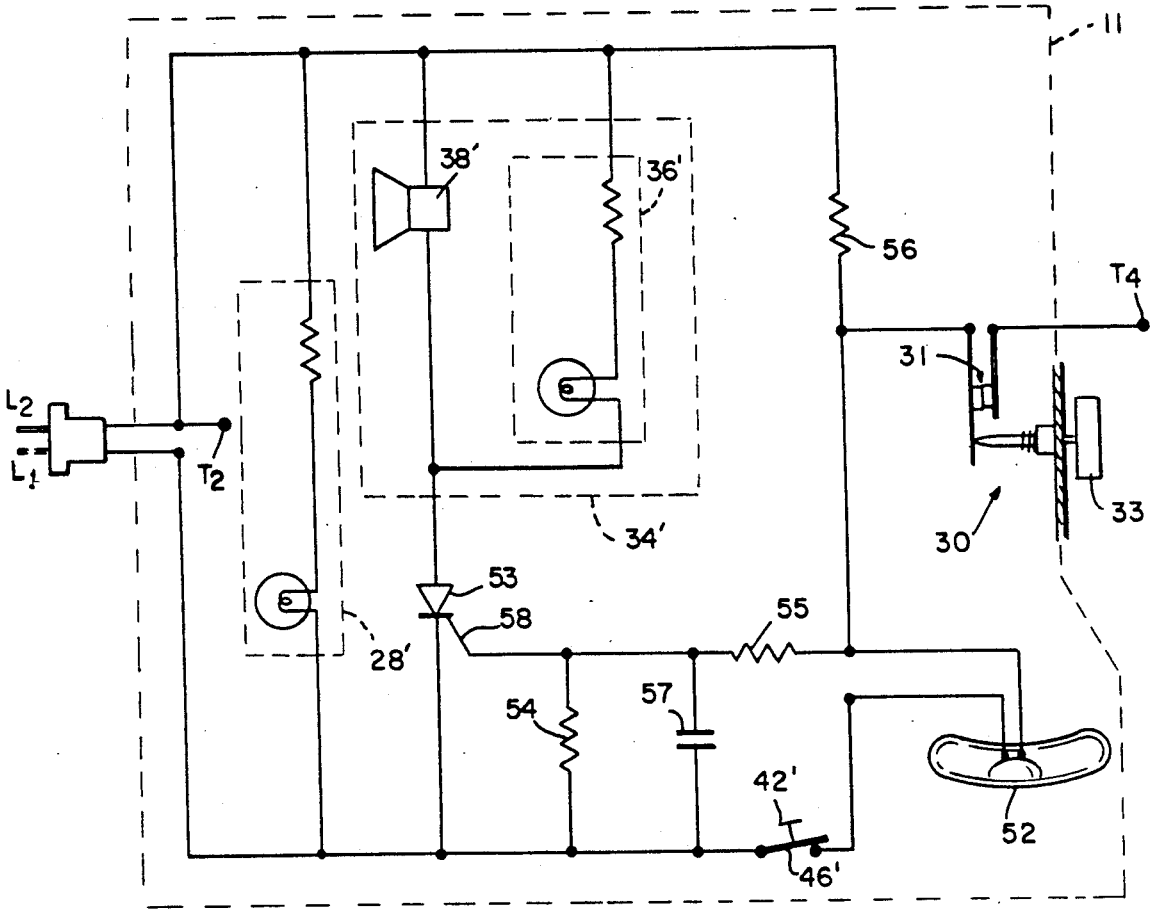
FIG. 2 shows an alert circuit for a heater using the present invention having a single tip-sensitive switch.

The thermostat 30 shown in both FIGS. 1 and 2 operates in a conventional manner to control the actuation of motor 26 and heater section 12, thereby controlling the temperature at which the space to be heated (not shown) is maintained. The thermostat 30 includes a pair of contacts 31 that are adjusted by a conventional thermostat control 33. In a known manner, the thermostat control 33 adjusts the orientation of the contacts 31 so that the contacts 31 will close to provide power to the motor 26 and heater section 12 when the temperature within the space to be heated falls below a temperature selected by the thermostat control 33. Likewise, the contacts 31 will open when the temperature within the space to be heated rises above the preselected temperature.

In FIG. 1, the thermostat 30 also includes pendulum means 32 that cooperates with the contacts 31 to function as a tip switch to open the contacts 31 should the heater assembly 10 be tipped beyond a preselected number of degrees, thereby removing power from the motor 26 and the heater section 12. The thermostat 30 is connected to the second pole L2 to complete the circuit through the heater section 12 and motor 26. In addition, a "power on" light 28 is provided that is coupled between the second pole L2 and the motor 26 to indicate to the operator that the heat selector switch 20 is in one of the two "on" positions.

The heater assembly 10 shown in FIG. 1 is configured to include alert means 34 to indicate to the operator that the heater section 12 has been disabled either because of an overheat condition or because of a tip-over condition. The alert means 34 includes a light 36 and a buzzer 38 that are connected in parallel between second pole L2 and an overheat control unit 42. The overheat control unit 42 includes a conventional single pole, double throw temperature control switch having three terminals 43, 44, and 45 and a switch-activating overheat sensor 47 for sensing temperature in heater assembly 10. First terminal 43 is coupled to first pole L1, second terminal 44 is connected to the switch arm 22 of the heat selector switch 20, and third terminal 45 is connected to the common terminal of the light 36 and the buzzer 38. A switch arm 46 is coupled to the first terminal 43, and moves between the second terminal 44 and the third terminal 45 in response to an instruction from the overheat sensor 47. It will be understood that, in other embodiments, the switch arm 46 could be configured to function as the overheat sensor, eliminating the necessity of a separate overheat sensor 47.

As illustrated in FIG. 1, when the switch arm 46 is in contact with the second terminal 44, power is supplied to the heat selector switch 20 for selectively powering the heater section 12. However, when the overheat sensor 47 in overheat control unit 42 is exposed to temperatures within the heater assembly 10 in excess of a predetermined threshold temperature, the switch arm 46 moves in a known manner to a position in contact with the third terminal 45. This movement removes power from the heat selector switch 20 to disable the heater section 12. It will be understood that it is necessary to disable the heater section 12 should an over-temperature condition occur within the heater assembly 10.

To provide an indication to the operator that the heater section 12 has been disabled, FIG. 1 shows a pair of normally open signaling circuits being provided, each signaling circuit including the alert means 34 (illustratively light 36 and buzzer 38). The first signaling circuit includes overheat control unit 42 and alert means 34 while the second signaling circuit includes tip switch 48 and alert means 34. The overheat control unit 42, heat selector switch 20, heater section 12, and thermostat 30 cooperate in series to form a normally closed heating circuit.

When the switch arm 46 shown in FIG. 1 moves into contact with the third terminal 45, the heating circuit is opened to disable heater section 12. Simultaneously, the normally open first signaling circuit is closed to provide power to the light 36 and buzzer 38 to provide both an aural and visual indication to the operator that the heater section 12 has been disabled and that an abnormal condition exists within the heater assembly 10. The first circuit means includes the overheat control unit 42, as well as the first signaling circuit just described.

In addition, second circuit means is provided as shown in FIG. 1 for activating the alert means 34 whenever the heater assembly 10 is tilted to a predetermined position relative to the normal upright position. The second circuit means includes a normally open tip switch 48 that includes normally open contacts 49 and pendulum means 51. One terminal of the tip switch 48 is connected to first pole L1, while the other terminal is connected to the third terminal 45 of the overheat control unit 42. When the heater assembly 10 is tilted through a preselected angle, the pendulum means 51 pivots to close the normally open contacts 49, thereby closing the second circuit means. Thus, the second circuit means, including the tip switch 48, operates in parallel with the overheat control unit 42 to provide a second signaling circuit which activates the alert means 34, thereby alerting the operator that an abnormal condition exists with the heater assembly 10 (in this case an abnormal orientation of the heater assembly 10 relative to a normal upright position). Due to the novel structure of heater assembly 10, the alert means 34 is actuatable by second signaling circuit in a manner wholly independent of the operation of the overheat control unit 42.

Thus, because the second circuit means cooperates independently of the position of the switch arm 46 in the overheat sensor 42, the alert means 34 can be activated by either an overheat condition within the heater assembly 10 or by an abnormal orientation of the heater assembly 10 relative to a normal upright position. Therefore, only one alert means 34 is necessary to provide an indication to the operator of either of these abnormal condition.

FIG. 2 shows an alternative circuit 11 for supplying power and indicating faulty operation of the heater assembly 12 shown in FIG. 3. The terminals T2 and T4 of FIG. 3 are intended to be connected to terminals T2 and T4 of FIG. 2 respectively. Terminal T2 is connected to second pole L2 of the power plug. The terminal T4 is connected to first pole L1 of the power plug in series with the thermostat 30, a tip-switch 52 and an overheat control unit 42'. The function and operation of the thermostat 30 is unchanged from the previously discussed operation relating to FIG. 1.

The circuit 11 includes a "power on" light 28' similar in operation to "power on" light 28 shown in FIG. 1 It is to be noted, however, that "power on" light 28' will be illuminated at any time that power is applied to poles L1 and L2 of the plug supplying power to circuit 11. The illumination of "power on" light 28' does not depend on the position of switch arm 22 of switch 20 shown in FIG. 3 which is unlike "power on" light 28 of FIG. 1 which is illuminated only when switch arm 22 is situated in contact with either terminals 23 or 24.

The circuit 11 of FIG. 2 also includes an alert means 34' including a light 36' and a buzzer or other audible alarm 38'. The operation of the alert means 34' is controlled by a solid state switch 53, which can be a SCR or triac, resistors 54, 55, and 56, and capacitor 57. The resistance value of resistors 54 and 55 should be selected so as to be much greater than the contact resistances present in both tip-switch 52 and overheat control unit 42'. This selection of resistances assures that virtually no current will flow through resistances 54 and 55 so long as control unit 42' and switch 52 are in a closed position. Thus so long as control unit 42' and switch 52 are closed, a negligible potential drop will exist between pole L1 and thermostat 30. In such situation, a potential drop will exist across resistor 56 approximately equal to the total line voltage across poles L1 and L2 of the plug.

The resistance of resistor 56 is selected to be much larger than the resistance of either heater element 14 or heater element 16 of heater section 12 shown in FIG. 3. This assures that when the switch arm 22 of switch 20 is connected to either terminal 23 or terminal 24, substantially all of the current will flow through the circuit shown in FIG. 3 so long as the contacts 31 of thermostat 30 remain closed. In addition, the resistance values of resistors 54, 55, and 56 are selected so that under certain conditions, discussed below, the series of resistors 54, 55, and 56 will construct a potential divider providing a triggering voltage to trigger input 58 of switching device 53. A typical value for resistor 54 is 10,000 ohms while a typical value for resistors 55 and 56 is 100,000 ohms each. The capacitor of 57 acts together with the resistor 54 in a conventional manner as a surge suppressor to prevent undesired triggering of the switching device 53 due to sudden variations in line voltage across poles L1 and L2 of the plug.

The overheat control unit 42' includes a switch activating overheat sensor and switch 46' similar to that disclosed in connection with FIG. 1. The switch 46' included in the overheat control unit 42' need only be a single pole, single throw switch which is normally closed during conventional operation but opens in the event that excessive heat is sensed by the control unit 42'. In the event that an overheat condition is sensed, the switch arm 46' moves from its illustrated normally closed position to an open position. With the switch 46' in an open position, a potential develops across resistance 54 sufficient to trigger the switching device 53 into conduction thereby causing the alarm means 34' to operate.

Tip switch 52 which is illustrated as a mercury switch is arranged to normally conduct electricity when the heater containing the circuit 11 is in its normal upright attitude. In the event that the heater is tipped, the mercury within the mercury switch will be displaced in a known manner so as to open the contacts of the switch. The effect of the opening of the contacts of switch 52 will be the same as the opening of switch 46' previously discussed. In addition to triggering the alarm means 34', the opening of either tip switch 52 or overheat control unit 42' will cause the current available to the heater section 12 to be diminished to nearly zero thereby reducing any inherent hazard which might be presented by the continued operation of the heater section 12.

The heater assembly 10 of the present invention is able to provide an aural and visual warning to the operator that either of two abnormal conditions exist within the heater assembly 10. The overheat control unit 42, 42' operates both to disable the heater section 12 and to activate the alert means 34, 34'. In addition, the tip switch 48, 52 operates independently of the overheat control unit 42, 42' to activate the alert means 34, 34' whenever the heater assembly 10 is tilted to an abnormal orientation. When the overheat control unit 42 activates to disable the heater section 12, the activation of the alert means 34 provides an indication to the operator that the heater assembly 10 has been turned off due to an abnormal condition within the heater assembly 10, and not because of the normal functioning of the thermostat 30.

Although the invention has been described in detail with reference to the illustrated preferred embodiments and specific examples, variations and modifications exist within the scope and spirit of the invention as described and defined in the following claims.

What is claimed is:

1. An alert system for monitoring the operation of a heater assembly, the heater assembly having heater means for generating heat to warm a space to be heated, thermostatic means for sensing the temperature of the space to be heated, and switch means responsive to the thermostatic means for controlling the operation of the heater means, the alert system comprising:

a signaling means for emitting a humanly perceivable signal, signal switch means connected to the signaling means for enabling the signaling means to emit the signal, tilt sensing means for disabling the heater means in response to a predetermined tilting movement of the heater assembly relative to a normal upright position, and circuit means connecting the tilt sensing means and the signal switch means for causing the signal switch means to enable the signaling means upon disablement of the heater means by the tilt sensing means regardless of the temperature sensed by the thermostatic means.

2. The alert system of claim 1 further comprising overheat control means for disabling the heater means upon elevation of the temperature in the heater assembly to a temperature in excess of a predetermined threshold temperature, the overheat control means being connected to said circuit means to enable the signaling means upon disablement of the heater means.

3. The alert system of claim 1 wherein the signaling means includes at least one means for issuing an audible signal to a person in proximity to the heater assembly.

4. The alert system of claim 3 wherein the signaling means further includes light means for providing a visible signal to a person in proximity to the heater assembly.

5. A heater assembly comprising heat generating means for generating heat to warm a space to be heated, thermostatic means for sensing the temperature of the space to be heated, and switch means responsive to the thermostatic means for controlling the operation of the heater means, tilt means for sensing a predetermined tilting movement of the heater relative to a normal upright orientation, the tilt means including circuit means which operates in response to such tilting movement to disable the heat generating means, and alert means for indicating a tilting movement of the heater means sufficient to disable the heater means, the alert means being operable regardless of the temperature sensed by the thermostatic means.

6. The heater assembly of claim 5 further comprising temperature sensitive means for disabling the heat generating means upon exposure to a temperature in excess of a predetermined threshold, the temperature sensitive means coupled to the alert means for activating the alert means upon disablement of the heater means.

7. The heater assembly of claim 5 further comprising air circulating means for circulating air by the heat generating means.

8. The heater assembly of claim 7 further comprising circuit means connecting the air circulating means to the heat generating means for causing the air circulating means to be disable with the disabling of the heat generating means.

9. An electric heater assembly operable in a normal upright orientation and susceptible to a tip-over condition comprising heater means for generating heat to warm a space to be heated, thermostat means for sensing the temperature in the space to be heated for controlling the heat generated by the heater means, overheat means coupled to the heater means for disabling the heater means upon sensing a temperature in the heater assembly in excess of a predetermined threshold temperature, tip-over means for disabling the heater means upon sensing a predetermined tilting movement of the heater assembly relative to the normal upright position, and alert means for indicating disablement of the heater means upon actuation of either the overheat means or the tip-over means, the alert means being operable regardless of the temperature sensed by the thermostat means.

10. The heater assembly of claim 9 wherein the alert means includes audible means for issuing an audible signal to a person in proximity to the heater assembly.

11. The heater assembly of claim 9 wherein the alert means includes light means for providing a visible signal to a person in proximity to the heater assembly.

12. The heater assembly of claim 9 wherein the heater means comprises an electrical resistance heating unit and a fan for circulating air by the resistance heating unit, both the resistance heating unit and fan being subject to disablement by the overheat means and the tip-over means.

13. An alert system for monitoring operation of an electric heater assembly, the heater assembly being operable in a normal upright orientation but susceptible to a tip-over condition, and having heater means for generating heat to warm a space to be heated, thermostatic means for sensing the temperature of the space to be heated, and switch means responsive to the thermostatic means for controlling the operation of the heater means, the alert system comprising first circuit means for automatically disabling the heater means upon elevation of the temperature within the heater assembly to a temperature in excess of a predetermined threshold temperature, second circuit means for automatically disabling the heater means in response to a predetermined tilting movement of the heater assembly relative to the normal upright position, and signaling means operable regardless of the temperature sensed by the thermostat means, for indicating the disablement of the heater means by one of the first and second circuit means.

14. The alert system of claim 13 wherein the signaling means comprises an audible signal generating means for generating a signal audible to a person situated in the space to be heated.

15. The alert system of claim 14 wherein the signaling means comprises light means for providing a signal visible to a person situated in the space to be heated.

16. The alert system of claim 13 further comprising switch means responsive to the first and second circuit means for coupling a source of power to the signaling means.

17. The alert system of claim 16 further comprising means coupled to the switch means for responding to either of the first and second circuit means to develop a potential for operating the switch means.

18. The alert system of claim 13 further comprising power signal means for signaling that power has been applied to the heater assembly.

19. The alert system of claim 18 wherein the power signal means and the first circuit means are coupled together such that disabling of the heater means by the first circuit means will simultaneously remove power from the power signal means.

20. The alert system of claim 13 further comprising thermostatic means responsive to the temperature in the space to be heated for controlling the operating of the heater means, the first and second circuit means being operable independent of the temperature of the space to be heated.

* * * * *